United States Patent [19]

Raiteri

[11] 4,179,868

[45] Dec. 25, 1979

[54] BAG FEEDING APPARATUS FOR POWDER MATERIAL PACKAGING

[75] Inventor: Angelo Raiteri, Ivrea, Italy

[73] Assignees: UNICEM-Unione Cementerie Marchino, Emiliane e di Augusta, S.p.A., Casale Monferrato; Andrea Doria, Ivrea, both of Italy

[21] Appl. No.: 905,321

[22] Filed: May 12, 1978

[30] Foreign Application Priority Data

Jun. 10, 1977 [IT] Italy ..... 68352 A/77

[51] Int. Cl.[2] ..... B65B 43/26

[52] U.S. Cl. ..... 53/571; 141/315

[58] Field of Search ..... 53/571, 573; 141/313, 141/315

[56] References Cited

U.S. PATENT DOCUMENTS

| | | | |
|---|---|---|---|
| 3,053,027 | 9/1962 | Frost | 53/571 |
| 3,312,038 | 4/1967 | Knauf | 53/573 |
| 3,423,903 | 1/1969 | Miller | 53/571 |
| 3,691,715 | 9/1972 | Kelly et al. | 53/571 X |

*Primary Examiner*—Travis S. McGehee

*Attorney, Agent, or Firm*—Marvin Reich

[57] ABSTRACT

The bags have each a pair of flanges folded on two edges, one of the flanges being provided with a valve. The bags are placed vertically in a magazine, with the valve flange located on the vertical plane of a valve oening device. The bags are picked up one at a time by a device including a set of vacuum cups carried by a pivoted arm. The valve flange of the bags is firstly engaged by the vacuum cups. The arm is then rocked on said plane to align the flange with the opening device. Finally, the arm is telescopically extended the insert the flange into the opening device.

9 Claims, 6 Drawing Figures

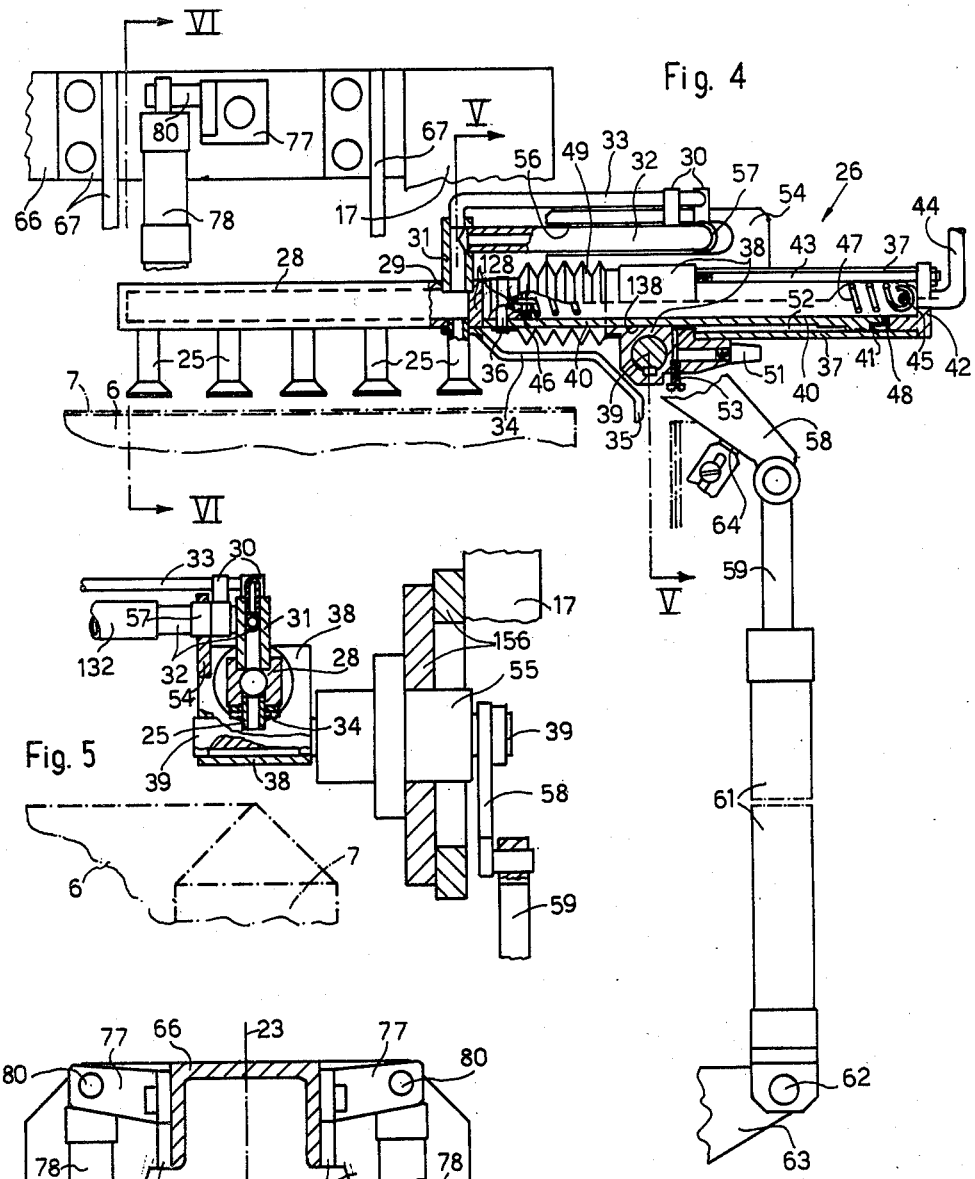
Fig. 4
Fig. 5
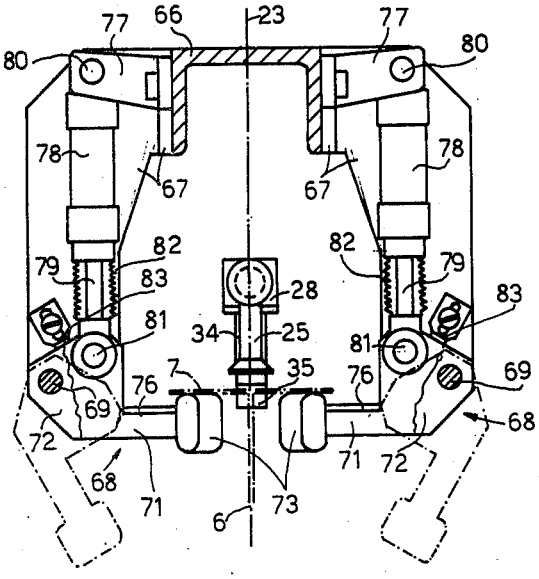
Fig. 6

BAG FEEDING APPARATUS FOR POWDER MATERIAL PACKAGING

BACKGROUND OF THE INVENTION

This invention relates to a bag feeding apparatus for powder material packaging, wherein the bags are provided each one with a pair of flanges bent on two opposite edges of the bag, one of said flanges being provided with a valve, and wherein a magazine holds the bags standing substantially vertically on another edge deprived of flange, comprising means for picking-off one bag at a time from the magazine to feed it to a valve opening device having a substantially horizontal axis.

There are known apparatus of the above type, wherein the picking-off means, in form of vacuum cups, firstly peel the bag from the stack by means of a first rectilinear movement, then rotate the bag by means of a second rotational movement, and finally carry the bag to the spout by means of a third movement, generally a rectilinear one. Therefore, these bag feeding apparatus are rather intricate and unreliable.

Main object of the invention is to provide a bag feeding device, wherein the bag is picked-off and positioned by moving the picking-off means through a very simple mechanism to obtain a very high reliability.

SUMMARY OF THE INVENTION

According to the invention, the bag feeding device is characterized in that said magazine holds the bags in such a position as to locate the valve flange substantially on a vertical plane including said horizontal axis, said means being adapted to engage said valve flange and being movable on said vertical plane only.

More particularly, said means comprise at least a pair of vacuum cups mounted on an arm adapted to rock on said plane from a substantially vertical position where said cups engage said valve flange to a horizontal position where said valve flange lies on said axis.

The following description represents a preferred embodiment of the invention, made by way of example and not in a limiting sense, in conjunction with the accompanying drawings.

BRIEF DESCRIPTION OF THE DRAWINGS

FIG. 4 is a lateral, partially sectional view of a detail of FIG. 1, in an enlarged scale;

FIG. 5 is a partial sectional transversal view taken along the line V—V of FIG. 4;

FIG. 6 is a partial sectional transversal view taken along the line VI—VI of FIG. 4.

DESCRIPTION OF THE PREFERRED EMBODIMENT

Figure 1:
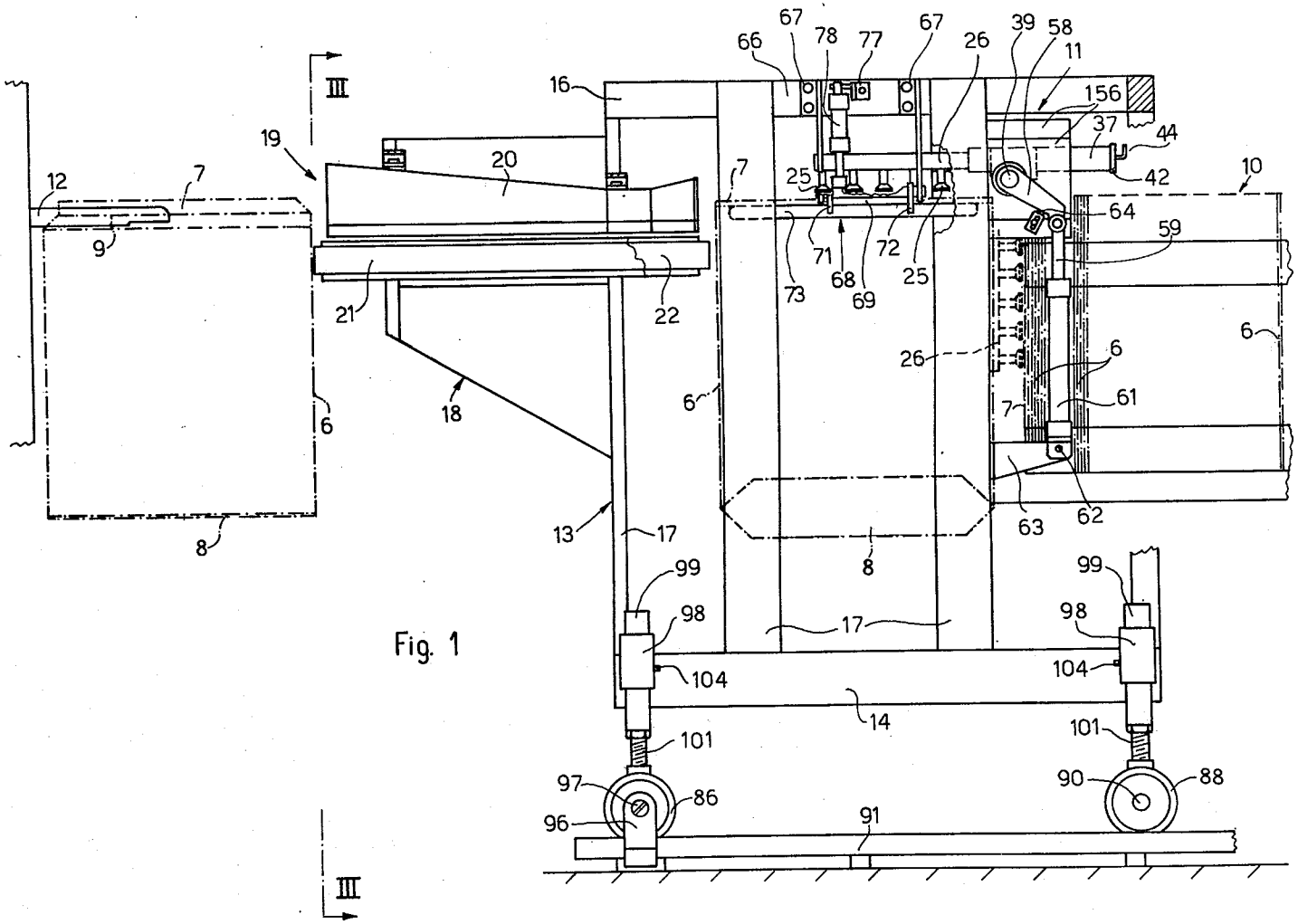
FIG. 1 is a lateral, partially sectional view of a bag feeding apparatus according to the invention.

The feeding apparatus is particularly adapted to feed bags 6 (FIG. 1), made of paper or other similar material, which are provided, on two opposite edges, with two flanges 7 and 8. The flange 7 is provided with a conventional valve 9 to allow the filling of the bag 6.

The bags 6 are located in a magazine, generically indicated by the numeral 10, in a substantially vertical position, and lie on one of the bag edges deprived of flanges, so as to present the flanges 7 and 8 (FIG. 2) to the side of picking-off the bags. The bags 6 are pushed toward the picking-off position in any known manner and are stopped at the picking-off position by stop edges not shown in the drawings.

The feeding apparatus is generically indicated by the numeral 11 (FIG. 1) and is provided for picking-off one bag 6 at a time from the magazine 10 for inserting it on a spout 12 of an automatic machine for packaging powder material, like cement, flour, grains, fertiliser and similar materials. Particularly, the feeding apparatus 11 comprises a framing structure 13 secured to the magazine 10 and including a lower frame 14 and an upper frame 16 mutually connected by a set of uprights 17.

The framing structure 13 also comprises a bracket 18, on which a device 19 is located for opening the valve 9 of the bag 6. This device 19 includes a hollow shaper 20 having a substantially horizontal axis and a variable section. The shaper 20 is also aligned with the spout 12. The device 19 comprises a pair of belts 21 and 22 (FIGS. 2 and 3) mutually in contact substantially on a vertical plane 23, shown by a dot and dash line, and passing through the middle of a lower notch (FIG. 3) of the shaper 20. The belts 21 and 22 are moved continuously and are adapted to engage the body of the bag 6, below the notch 24, so as to push the flange 7 into the shaper 20, substantially in the manner described in the U.S. Pat. application No. 833,526 filed on Sept. 15, 1977 in the name of the same applicants.

According to the invention, the magazine 10 (FIG. 2) is located so as to hold the bags 6 in a position to bring the middle portion of the flange 7 provided with the valve 9 substantially on the vertical plane 23. The feeding apparatus comprises a set of five vacuum cups 25 (FIG. 1) aligned on a rectilinear line of the plane 23. The vacuum cups 25 are carried by an arm, generically indicated by the numeral 26, which is fulcrumed on the framing structure 13. The arm 26 is adapted to be rocked between a vertical position indicated by broken lines in FIG. 1, wherein the vacuum cups 25 engage the flange 7 of the bag 6, to the substantially horizontal position shown in FIG. 1, wherein the flange 7 is presented in front of the shaper 20.

Particularly, the arm 26 comprises a hollow bar 28 (FIG. 4), on which the vacuum cups 25 are secured. The bar 28 is provided with a hole 29, on which a hub 31 is tightly secured. This hub 31 is also tightly connected to an elbow duct 32, in turn connected, through a flexible duct 132 (FIG. 5), to a not shown vacuum pump for enabling the vacuum cups 25. The hub 31 is also tightly connected to a second duct 33, in turn secured to the duct 32 by means of brackets 30. The duct 33 is connected, through a not shown electrovalve, to a compressed air source, whereby upon operating said electrovalve the compressed air neutralizes the vacuum in the hub 31 and in the bar 28, thus disabling the vacuum cups 25.

Secured to the bar 28, in correspondence of the last rightward vacuum cup 25 (FIG. 4), is a plate 34 having a bent lug 35 adapted to engage the flange 7 of the bag 6, as it will better seen hereinafter. An end 128 of the bar 28 is connected through a pin 36 to a hollow piston 40 slidable on a cylinder 37 and on a hole 138 of a block 38 secured to the cylinder 37. The block 38 is secured to a pivot 39 rotatable on a bushing 55 (FIG. 5), which in turn is secured by means of intermediate plates 156 to two uprights 17 of the machine framing support 13.

A gasket ring 41 (FIG. 4) tightly but slidably connects the piston 40 and the cylinder 37, the free end of which is closed by a substantially square head 42. This latter is connected to the block 38 by four pulling bars 43 located at the four angles of the head 42. Connected to this latter is also a duct 44 of the compressed air, which is controlled by another electrovalve not shown in the drawings.

A spring 47 is tensioned between a pin 45 located on the head 42 and a pin 46 located at the end 128 of the bar 28 and normally holds the piston 40 to contact a stroke and elastic ring 48 secured to the head 42. Protecting bellows 49 are also located between the block 38 and the piston 40. A valve 51 is located on the block 28 for a controlled exit of the air from a dampening chamber 52. The valve 51 is adjustable by means of a threaded pin 53. Finally, secured to the block 38 is a plate 54 having a slot 56 in which a portion 57 of the elbow duct 32 can slide and rotate.

Secured to an extension of the pivot 39 protruding from the bushing 55 (FIG. 5) is an arm 58, the end of which is linked to a rod 59 (FIG. 4) of a piston of a fluodynamic cylinder 61. The lower end of the cylinder 61 is pivoted at 62 on a plate 63 secured to the upright 17 (FIG. 1) of the framing structure 13. The cylinder 61 is fed through two ducts not shown in the drawings, under the control of two electrovalves, in a known manner. A stop member 64, adjustable in a know manner, exactly defines the position of the arm 26 shown in FIG. 4, so that the arm 26 holds the vacuum cups 25 aligned with the shaper 20.

Figure 2:
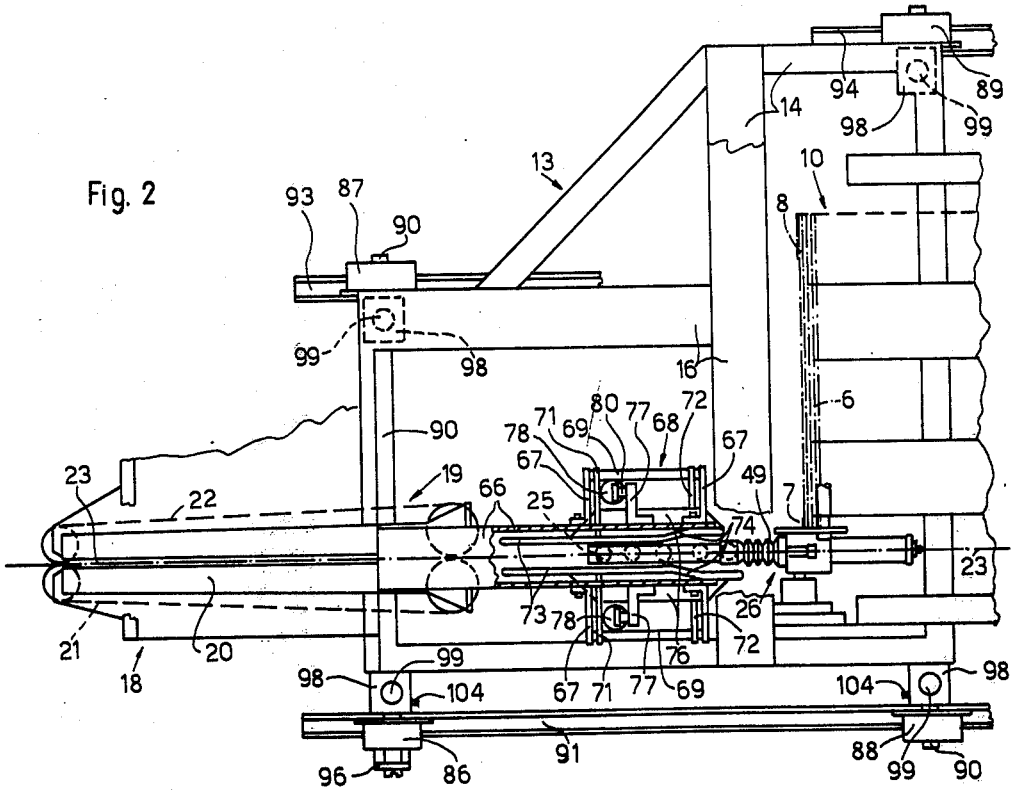
FIG. 2 is a partial plan view of the apparatus of FIG. 1.
Figure 3:
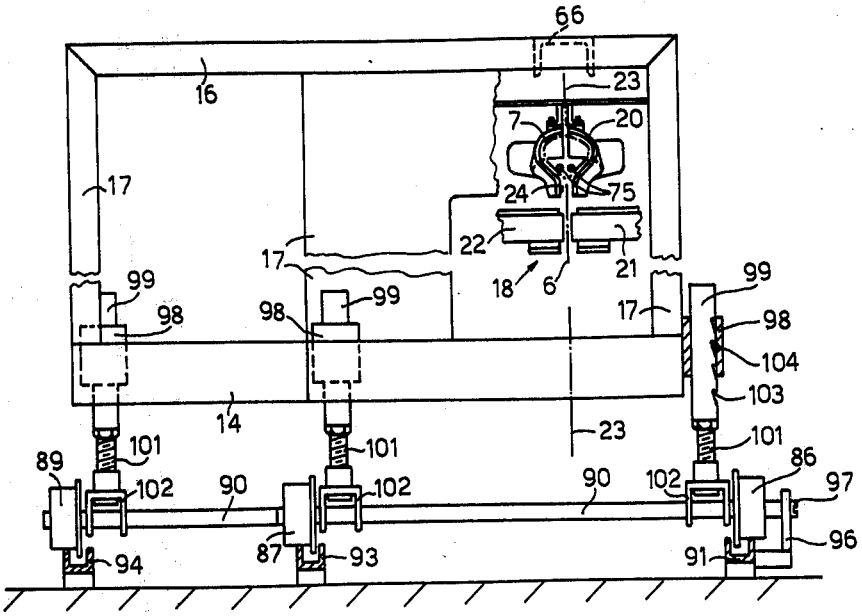
FIG. 3 is a sectional view taken along the line III—III of FIG. 1.

A longitudinal bar 66 (FIG. 6), having a downwards directed C-shaped section, is secured to the upper frame 16 (FIG. 1). Secured to each one of the two wings of the bar 66 (FIG. 4) are two brackets 67, pivotally mounting a frame generically indicated by the numeral 68 (FIG. 6). Each frame 68 includes a shaft 69 rotatable on the two brackets 67. The shaft 69 is secured to a pair of arms 71 and 72 in turn secured to a bar 73 having an oval section and longitudinally shaped so as to form a substantially converging portion 74 (FIG. 2). The bar 73 and the arms 71 and 72 are also mutually connected by plates 76 making stiff the frame 68.

Furthermore, secured to each wing of the bar 66 is a L-shaped bracket 77 (FIG. 6), which carries a pivot 80 pivotally mounting an end of a fluodynamic cylinder 78 adapted to be operated through a pair of not shown ducts, under the control of two electrovalves. Each cylinder 78 cooperates with a piston connected to a rod 79 fulcrumed at 81 on the corresponding arm 71 and protected by bellows 82.

At rest the cylinders 78 hold the frames 68 in the closed position of FIG. 6, in which each arm 71 contacts an adjustable stop 83. In this position, the two oval bars 73 have the greater axis of their section directed vertically, and the portions 74 (FIG. 2) are converging toward the shaper 20, whereby the two bars 73 form a guide for the bag 6 and a support for the flange 7. In this position the left portions of the bars 73 are aligned with two stationary bars 75 (FIG. 3) located inside the shaper 20.

The apparatus for feeding the bags 6 operates as follows.

The cycle of taking-off and feeding the bag is controlled by a cyclically rotating cam shaft, the cams of which control a set of microswitches for operating the individual electrovalves. At the beginning of the cycle, the cylinders 78 (FIG. 6) are operated so as to push the piston rods 79 downwards. The rods 79 rock the frames 68 as to bring them to the open position shown by broken lines in FIG. 6.

During this rotation, the cylinder 61 (FIG. 4) is operated as to push the piston rod 59 upwards. The rod 59 rocks the arm 58 counterclockwise together with the pivot 39 and the block 38, whereby the entire arm 26 is rocked till reaching the substantially vertical position, indicated by broken lines in FIG. 1, where the vacuum cups 25 contact the flange 7 of the first bag 6 of the magazine 10. The vacuum in the duct 32 (FIG. 4) causes then the flange 7 to adhere immediately to the vacuum cups 25.

Thereafter, the cylinder 61 is operates as to return the rod 59 downwards. Then the arm 58 rocks the arm 26 clockwise, whereby the vacuum cups 25 pick-off the engaged bag 6 from the magazine 10. The weight of the bag 6 causes the bag to assume a substantially vertical position, while the vacuum cups 25 displace the flange 7, holding it constantly perpendicular to the direction of the movement and consequently to the plane 23. When the arm 58 is stopped against the stationary stop member 64, the arm 26 is located in a substantially horizontal position and the flange 7 is aligned to the shaper 20.

Immediately after having brought the flange 7 over the two bars 73 (FIG. 6), the two cylinders 78 are operated to displace the piston rods 79 upwards. The two frames 68 are then rocked upward till stopped by the stops 83, in the position of FIG. 6. The two bars 73 thus locate the bag 6 positively to a substantially T-position with respect to the flange 7, in the case the speed of taking-off or any other reason did not allow the weight of the bag 6 to locate it to the vertical position.

Thereafter the compressed air is temporarily sent, through the duct 33 (FIG. 4) and the hub 31, into the bar 28, whereby the vacuum of the cups 25 is neutralized and the flange 7 is released. The bag 6 is then moved to contact with the flange 7 the bars 73 (FIG. 6), which therefore do not pinch the bag, but merely form a guide thereof for the subsequent movement.

Simultaneously, the compressed air is sent to the duct 44 (FIG. 4), thus pushing the piston 40 leftwards against the urge of the spring 47, thus telescopically extending the arm 26 leftwards. This movement of the piston 40 is also dampened by the valve 51, which allows the air of the chamber 52 to exit gradually, whereby the sudden shock of the various moving parts is prevented.

In this movement of the piston 40, the lug 35 of the plate 34 engages the edge of the flange 7 opposite to the valve 9 and the upper portion of the lateral edge of the bag 6, thus pushing this latter toward the device 19 for opening the valve 9. The bag 6 in this movement is transversely guided by the bars 73, and is inserted between the belts 21 and 22 (FIG. 3), which push it into the shaper 20 (FIG. 1), till it is inserted on the spout 12. The disabling of the vacuum cups 25, before the movement of the piston 40, prevents the wear of the vacuum cups 25, which is caused by the pulling of the bag 6 in the direction perpendicular to that of the vacuum suction, particularly when it is engaged by the belts 21 and 22.

Finally, the electrovalve of the duct 44 (FIG. 4) is closed again, whereby the feeding of the compressed air is discontinued. The spring 47 restores the piston 40 rightwards, together with the bar 28 and the vacuum cups 25, till the piston 40 is stopped by the ring 48, whereby the picking-off cycle of the apparatus is completed and the next following one is immediately started.

It is thus clear that the movement of the bag flange 7 from the magazine 10 to the device 19 is effected solely on the plane 23, and that this movement is effected solely by rocking the arm 26 and telescopically extending it upon shifting the piston 40.

In order to remove the apparatus 11 from the packaging machine, for example for maintenance, the lower frame 14 (FIGS. 1 and 2) of the framing structure 13 is mounted on four wheels 86, 87, 88 and 89, in pair rotatable, through revolving bushings, on a common shaft 90. The wheels 86 and 88 are rotatable on a stationary rail 91, while the wheels 87 and 89 are rotatable on two corresponding rails 93 and 94. Finally, secured to the rail 91 is a bracket 96 having a hole at the height of the shaft 90 of the wheels 86 and 87. In turn this shaft 90 has a threaded axial hole, whereby it can be removably secured to the bracket 96 in the working position of the apparatus 11 by means of a screw 97 passing through the hole of the bracket 96 and screwed on the shaft 90.

In order to adequate the apparatus 11 to the height of the spouts 12 of the various packaging machines, the wheels 86, 87, 88 and 89 are adjustable in height with respect to the framing structure 13. Particularly, secured to the four angles of the frame 14 are four hubs 98 supporting as many hollow columns 99. A threaded rod 101 is screwed into each column 99, while the lower end of the rod 101 is rotatably mounted on a corresponding fork 102 (FIG. 3); the forks 102 in pairs being secured to the two shafts 90. Therefore the position of each fork 102 is finely and individually adjustable with respect to the corresponding column 99.

Each column 99 is provided on one side with a plurality of teeth 103 having a predetermined pitch, for example of 50 mm. Correspondently each hub 98 is provided with a horizontal hole, in which a stopping pin 104 is inserted for engaging a tooth 103 to lock the column 99 axially on the hub 98. By removing the pin 104, it is possible to displace the column 99, whereby each column 98 is individually adjustable in height by constant steps with respect to the corresponding hub 98.

Obviously, both the adjustment of the columns 99 and that of the rods 102 can be used to locate the apparatus 11 slightly inclined, for example to adequate its height the height of the magazine 10 (FIG. 1) and/or to that of the spout 12.

It is intended that various modifications and improvements can be made to the described apparatus without departing from the scope of the invention. For example, one or more fluodynamic cylinders can be replaced by mechanical controls, obtained by cams of a cyclically rotating main shaft. Furthermore, the operation of the plate 34 (FIG. 4) can be effected irrespective from the arm 26 supporting the vacuum cups 25. Finally, the shaper 20 can be replaced by any other device adapted to open the valve 9 of the bag 6.

What we claim is:

1. A bag feeding apparatus for powder material packaging, in which the bags to be fed are each provided with a pair of flanges folded on two opposite edges of the bag, one of said flanges being provided with a valve; said apparatus including a magazine for holding a plurality of bags to be fed with each one standing substantially vertically on an edge of the bag deprived of flange, a valve opening device having a substantially horizontal axis and adapted to receive the valve flange of the bag lying on said axis, mounting means for mounting said valve opening device so as to locate said horizontal axis substantially in the vertical plane in which the valve flange of said bags are standing in said magazine, a plurality of vacuum cups, for picking off said bags one at a time from said magazine, a rectilinear arm carrying said vacuum cup in an inline arrangement, a shaft for pivotally mounting said arm so that the various vacuum cups of said plurality have progressively increasing distances from said shaft, means for rocking said arm in said plane from a substantially vertical position where said cups engage said valve flange to a horizontal position where said valve flange lies on said horizontal axis, and means for telescopically extending said arm parallely to the line of cups to insert the valve flange of the picked off bag into said valve opening device.

2. An apparatus according to claim 1, wherein said shaft is located above said vacuum cups when said arm is in said vertical position.

3. An apparatus according to claim 1, including an element provided on said arm and bodily movable with said vacuum cups for pushing the bag toward said valve opening device by engaging the edge of the valve flange opposite to said valve during the telescopic extension of said arm.

4. An apparatus according to claim 1, including first fluodynamic means for rocking said arm between said two positions, and second fluodynamic means for extending said arm, said second fluodynamic means including a floudynamic cylinder and piston mounting said vacuum cups.

5. An apparatus according to claim 4, wherein said fluodynamic means are operated by a source of compressed air, and further including an element provided on said arm and bodily movable with said vacuum cups toward said valve opening device for engaging the edge of the valve flange opposite to said valve, vacuum duct means extending between said source and said vacuum cups, an operable electrovalve controlling communication between said source and said vacuum cups, said electrovalve being operated substantially at the beginning of the extension of said arm to render ineffective said vacuum cups, whereby the bag is moved toward said valve opening device solely by said element.

6. An apparatus according to claim 1, including a pair of members adapted to be moved one toward the other from an ineffective position to an effective position when said arm lies in said horizontal position, so as to locate the body of the picked off bag in said vertical plane, perpendicularly to said valve flange.

7. An apparatus according to claim 6, wherein each of said members includes a horizontal bar for guiding the bag while said arm is extending.

8. An apparatus according to claim 1, including a set of supports for mounting said apparatus, said supports being individually adjustable in height to adapt said apparatus to the height of a filling spout and/or to the height of said magazine.

9. An apparatus according to claim 8, wherein each one of said supports include a wheel rotating on a rail for allowing a quick access to said spout, at least one locking device being provided for locking one of said wheels in a predetermined position of the relevant rail.

* * * * *